United States Patent [19]

Ogden

[11] Patent Number: 4,580,309

[45] Date of Patent: Apr. 8, 1986

[54] SELF-CONTAINED MULTI-FUNCTION CLEANING SYSTEM

[75] Inventor: Stanley D. Ogden, Clovis, Calif.

[73] Assignee: Rug Doctor, Inc., Fresno, Calif.

[21] Appl. No.: 618,429

[22] Filed: Jun. 8, 1984

[51] Int. Cl.[4] ..... A47L 5/38; A47L 9/00; A47L 11/30

[52] U.S. Cl. ..... 15/300 A; 15/302; 15/314; 15/321

[58] Field of Search ..... 15/300 A, 301, 302, 15/314, 320, 321, 322; 55/259, 470, 472

[56] References Cited

U.S. PATENT DOCUMENTS

| | | | |
|---|---|---|---|
| 3,486,309 | 12/1969 | Wild | 15/300 A |
| 3,705,437 | 12/1972 | Rukavina, Jr. et al. | 15/322 |
| 3,896,521 | 7/1975 | Parise | 15/321 |
| 4,044,474 | 8/1977 | Greene et al. | 55/470 |
| 4,154,578 | 5/1979 | Bane | 15/321 |
| 4,194,262 | 3/1980 | Finley et al. | 15/321 |
| 4,348,783 | 9/1982 | Swanson | 15/320 |
| 4,475,264 | 10/1984 | Schulz | 15/321 |

*Primary Examiner*—Timothy F. Simone
*Attorney, Agent, or Firm*—Flehr, Hohbach, Test, Albritton & Herbert

[57] ABSTRACT

A compact, self-contained central vacuum cleaning machine has expandable vacuum suction and pressure capacities and variable vacuum suction. The machine performs a multiplicity of cleaning operations including dry vacuuming, wet vacuuming, hydro-extraction vacuuming and pressure washing.

11 Claims, 15 Drawing Figures

FIG. — 1
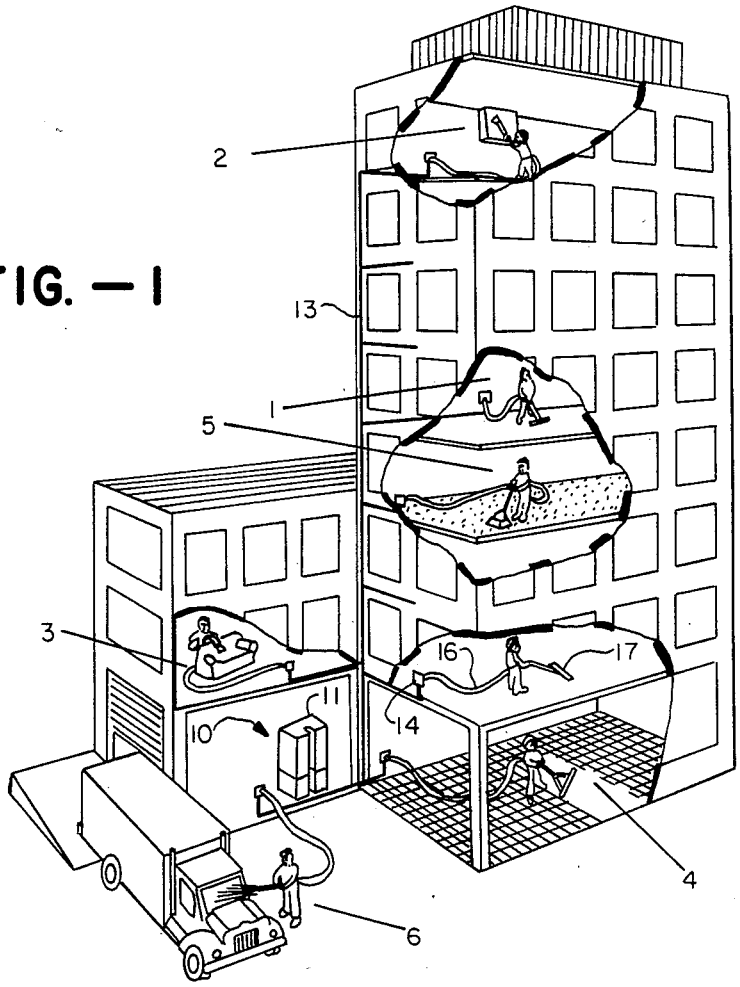
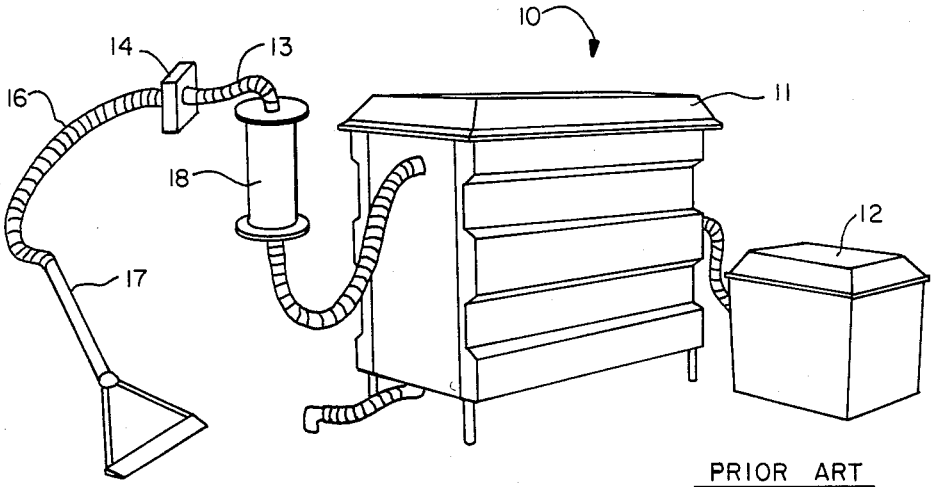
PRIOR ART
FIG. — 2

SELF-CONTAINED MULTI-FUNCTION CLEANING SYSTEM

BACKGROUND OF THE INVENTION

This invention relates to vacuum cleaning machines. In particular, the invention relates to a self-contained central vacuum cleaning machine which performs all of the following cleaning applications: dry vacuuming, wet vacuuming, hydro-extraction vacuuming (combined spray cleaning and wet vacuum), and pressure washing.

"Dry vacuuming" involves the application of vacuum suction by an applicator tool to lift dirt and debris from a surface for transfer through a vacuum hose to a temporary storage container.

"Wet vacuuming" also involves the use of vacuum pickup, but in a system which as sufficient suction lift capability and watertight construction to lift and transfer liquid and debris, typically to a sewer drain or a temporary storage tank.

"Hydro-extraction" vacuuming or "steam" cleaning involves the application of a high pressure stream or jet of an aqueous emulsifying solution to a surface and simultaneously or subsequently applying a wet vacuuming operation to pick up and transfer used cleaning solution to a temporary storage tank. State of the art machines mount the cleaning liquid nozzle and the vacuum pick-up head in the same applicator tool to facilitate the hyro-extraction operation. "Pressure Washing" involves the application of high pressure cleaning solutions or water to a "gun like" applicator tool having a long nozzle and a trigger to activate the high pressure jet of water for cleaning surfaces or machines of grease and foreign matter.

Self-contained vacuum cleaning machines are available in the prior art. Conventional self-contained systems are limited to single function operation or to dual function operation (wet/dry vacuuming) because different functions require separate equipment systems which impose prohibitive space and complexity requirements on self-contained units. The space and complexity constraints are even more difficult in high capacity systems (that is, high pressure liquid cleaning and high vacuum suction systems).

In particular, the space requirements for hydro-extraction systems are such that, with one exception, described below, it is believed that built-in hydro-extraction systems are not self-contained. That is, their various systems are installed as separate components. See, for example, the built-in hydro-extraction system described in U.S. Pat. No. 3,705,437. This is unfortunate because self-contained built-in systems are highly desirable.

Self-contained systems would be relatively easy to install and relatively efficient in the use of space.

The only self-contained built-in prior art system known to me which has hydroextraction capability or multi-function capability is the ACS Model 831 System. This system is available from the Automated Cleaning Systems Division of Rug Doctor, Inc., Fresno, California. An example of a commercial installation of the ACS Model 831 System is shown in FIG. 1. The central system itself is shown in the enlarged view of FIG. 2 and is designated therein by the general reference numeral 10. The overall installation includes the central system 10, which includes central unit 11, chemical container unit 12 and interceptor filter 18. The installation also includes a vacuum/high pressure/electrical conduit system 13, which connects the central unit 11 to individual wall outlets 14. Various types of applicator tools 17 are releasably connected to the wall outlets 14 via a flexible hose, generally designated 16, for performing various cleaning functions. Despite the relatively small size of the system 10—the central unit 11 is only 31" deep×55" wide×48" high—the system is designed to accept different applicator tools 17 for performing a number of cleaning functions. These include all of the following functions, which are designated by the corresponding reference numeral in FIG. 1: (1) central dry vacuum cleaning and dry vacuum extraction (at one or more machine wall outlets 14 simultaneously); (2) wet cleaning and drying (of air conditioning filters, refrigerators, kitchens, etc.); (3) wet cleaning of upholstery, etc.; (4) wet cleaning and instant drying of hard surfaces such as vinyl, concrete or tile floors; (5) hydro-extraction carpet cleaning and (6) hot/cold pressure washing and degreasing.

To implement these functions, central unit 11 contains on-board vacuum suction systems and liquid pumping systems; an automatic metering system for mixing selected concentrated chemical solutions with water; a chemical solution holding tank for temporarily storing the water-chemical mixture prior to application by the high pressure pumping system; and a waste recovery tank. The separate chemical container unit 12 holds a number typically five of containers of concentrated cleaning solutions which are selected at wall outlets and metered at the central unit 11 for delivery to the on-board holding tank and, then, to the applicator tool 17. The system 10 uses a duplex pump which provides standard pressure of about 350 psi for hydro-vacuum extraction cleaning and 700 psi for pressure washing. A positive displacement vacuum source provides 215 cfm of air at 180 inches of water lift (13.3 inches Hg).

SUMMARY OF THE INVENTION

Objects

The cleaning system 10 described above has demonstrated the desirability of self-contained, multiple function, commercial duty vacuum cleaning machines. Accordingly, it is an object of the present invention to extend this concept to single family and other residential uses in addition to commercial applications.

It is also an object of the present invention to provide the choice of commercial duty and/or residential duty capability in the same self-contained unit using a modular expandable system configuration.

Another object of the present invention is to provide the above capabilities in a completely self-contained central unit. This involves providing a compact, high-pressure, high-suction machine which contains the on-board capabilities of the above-described system 10, FIG. 2, and additionally the following on-board systems and items: water and solid waste interceptor filters; an expandable vacuum source system; chemical solution containers; and an outlet for connecting hoses and applicator cleaning tools.

SUMMARY

These and other objects are provided in a vacuum cleaning system which is an improvement of the self-contained commerical system shown in FIGS. 1 and 2. The present invention is a compact self-contained vacuum cleaning system which is suitable for multiple function operation including dry vacuuming, wet vacuuming, hydro-extraction vacuuming and pressure washing. In one aspect, the present vacuum cleaning system includes support means which is divided vertically into bottom, middle and top sections. The bottom section contains a chemical container section and a separate, substantially air-tight waste recovery tank. The middle section comprises a pumping section which itself comprises a high-pressure liquid pump and a cleaning solution storage section. The upper section comprises a vacuum source section for applying vacuum suction to the waste storage tank. The chemical container section is adapted for storing a plurality of bottles which hold concentrated chemical cleaning solutions, and includes means such as a venturi jet for selectively metering the chemicals in the bottles into a water inlet line. The resulting mixture of cleaning solution in water is transferred to a tank in the storage section for storage for supplying the mixture to the pump. The self-contained system also includes at least one vacuum/pressure outlet which communicates with the waste recovery tank via a filter and communicates with the pump via a liquid pressure line, and is adapted for connection to a cleaning tool, for supplying the water/chemical mixture under pressure to the tool and for applying vacuum suction to the tool to effect vacuum pickup.

In a preferred working embodiment, the vacuum source section comprises a plurality of vacuum blowers or pumps for supplying a selectively variable vacuum suction and air flow to the storage tank to thereby make available variable vacuum pickup and air flow at the outlet. The vacuum sources can be connected in parallel or in series or in series-parallel fashion to maximize system air flow or system vacuum suction or to optimize the combination of air flow and vacuum suction. In addition, the support means can be enlarged for mounting additional vacuum sources.

BRIEF DESCRIPTION OF THE DRAWINGS

The above and other aspects of the invention are described in detail in the accompanying drawings in which:

FIG. 1 illustrates the installation and use of a prior art central vacuum cleaning system;

FIG. 2 is an enlarged perspective view of the central unit of the system of FIG. 1;

DETAILED DESCRIPTION

Figure 3:
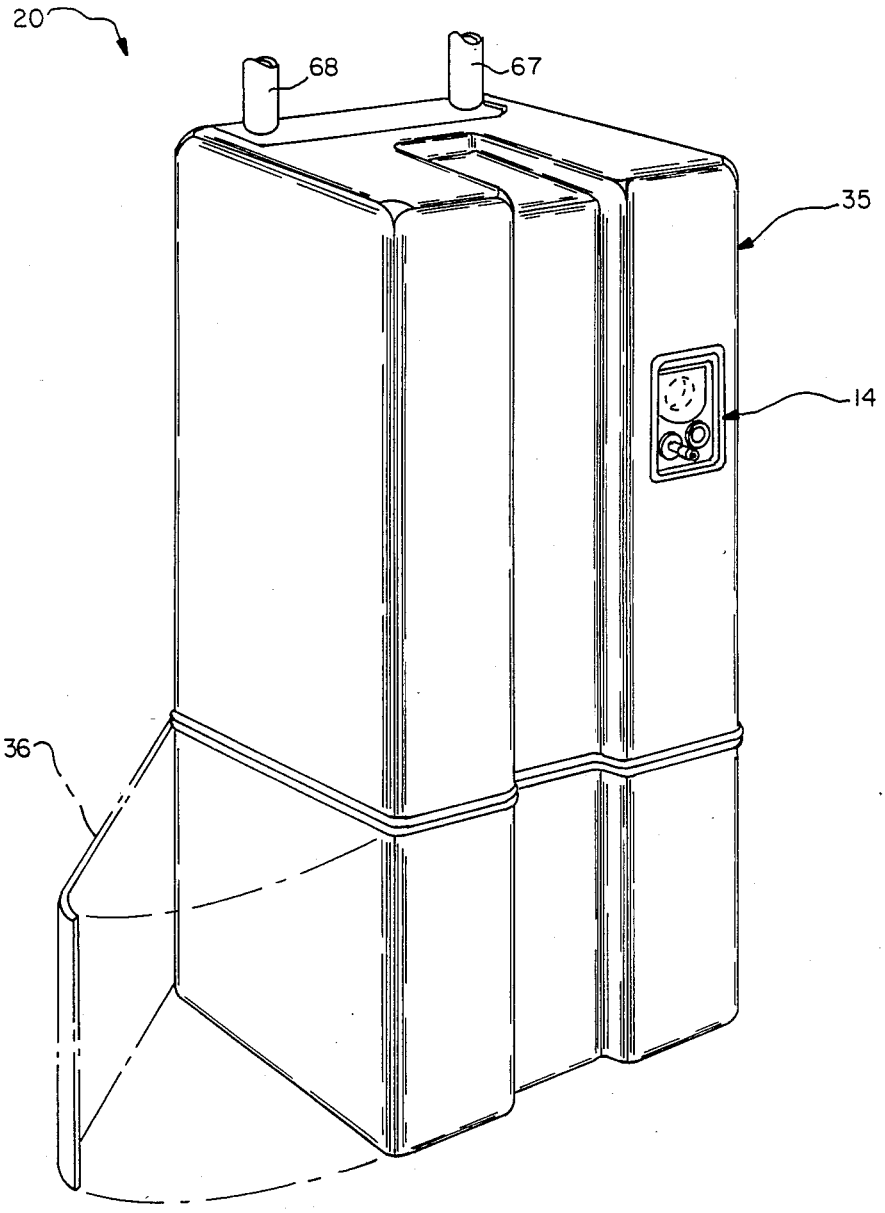
FIG. 3 is a perspective view, partly in schematic form, of the self-contained vacuum cleaning machine of the present invention.

The self-contained cleaning system or unit 20 of the present invention is shown in FIG. 3 with fiberglass cover 35 in place on the self-contained central unit, and in FIGS. 46 with the cover removed to disclose the internal systems and components. Basically, the system 20 comprises five major systems. These are: (1) a water and chemical supply system; (2) a solution pump pressure system; (3) a vacuum system; (4) a recovery tank and interceptor filter system and (5) a vacuum/pressure outlet system. The water and chemical supply system meters an aqueous chemical solution to a storage tank or container, from which the chemical solution is dispensed under pressure to a wall-outlet and an application tool by the solution pump system. The third, vacuum system is used to effect vacuum pickup of spent cleaning solution, water and debris at the tool for transfer to the recovery tank. The recovery tank and interceptor filter system includes the recovery tank, which temporarily stores and automatically dumps liquid waste picked up by the tool, and an in-line interceptor filter which removes large trash and debris from the incoming stream. Finally, there is provided a wall-outlet system containing termination points for the pressure and vacuum systems where hoses and cleaning tools may be connected for cleaning operations. One such outlet is included in the central unit 20. Others are remotely located from the central unit.

The vacuum cleaning system 20 is designed to connect to as many remote wall outlets 14 (see FIG. 1) as are required for adequate coverage within 150 feet of the central units. The vacuum system 20 connects to the wall outlets 14—14 via conduits 13 and thereby connects via hose 16 and, specifically, vacuum line 50 (FIG. 4) and high pressure line 51 to various applicator tools 17.

Figure 4:
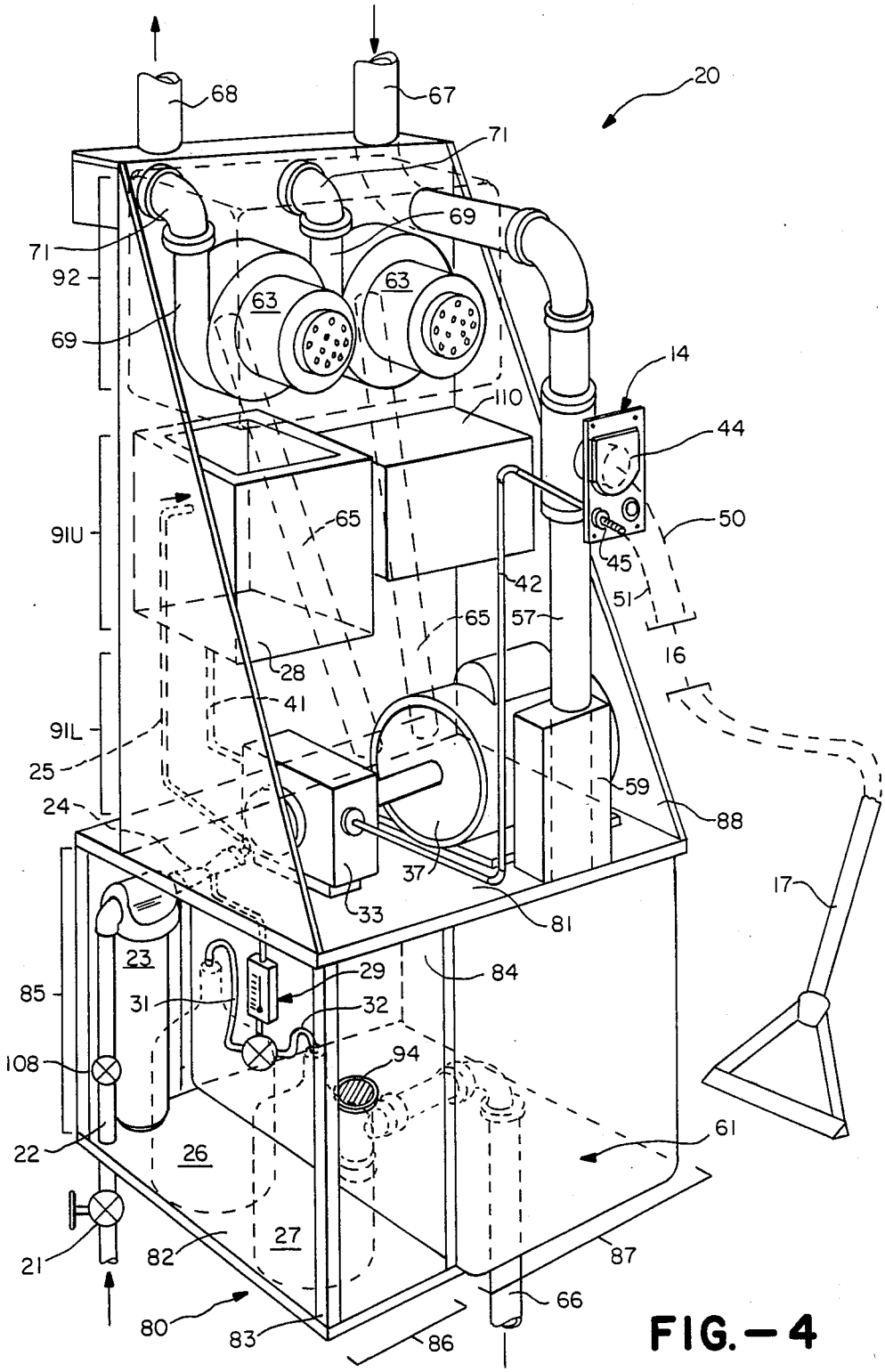
FIG. 4 is a perspective view in the manner of FIG. 3 with the external covers removed and with some components illustrated in phantom to facilitate understanding.

Referring to FIG. 4, the compact organization and the mounting arrangement of the five major systems of the self-contained central unit 20 are provided by a frame or support assembly 80 which defines the previously-mentioned bottom, middle and top sections. Middle-section base 81 is supported on lower base 82 by vertical frame members or posts 83—83. These uprights 83—83 and a vertical panel 84 divide bottom section 85 into chemical container section 86 ("chemical section 86") and recovery tank section 87 ("recovery section 87"). Triangular vertical side panels 88—88 and a rectangular back panel 89 are mounted above middle base section 81 for defining middle section 91 and upper section 92. The middle section includes a lower, pump section 91L and an upper, cleaning solution storage (and electronics control compartment) section 91U ("storage section 91U") and a vacuum/pressure outlet 14. Finally, upper section 92 is the vacuum blower section. This organization permits very high capacity vacuum and pressure systems in a self-contained machine which is only 18 inches deep×52–61 inches tall×21 inches wide. The specific location of the components of the five major systems will be evident below in conjunction with the discussion of the details of the major systems and their combined operation.

Water/Chemical Supply System (Chemical and Storage Sections 86,91)

Figure 5:
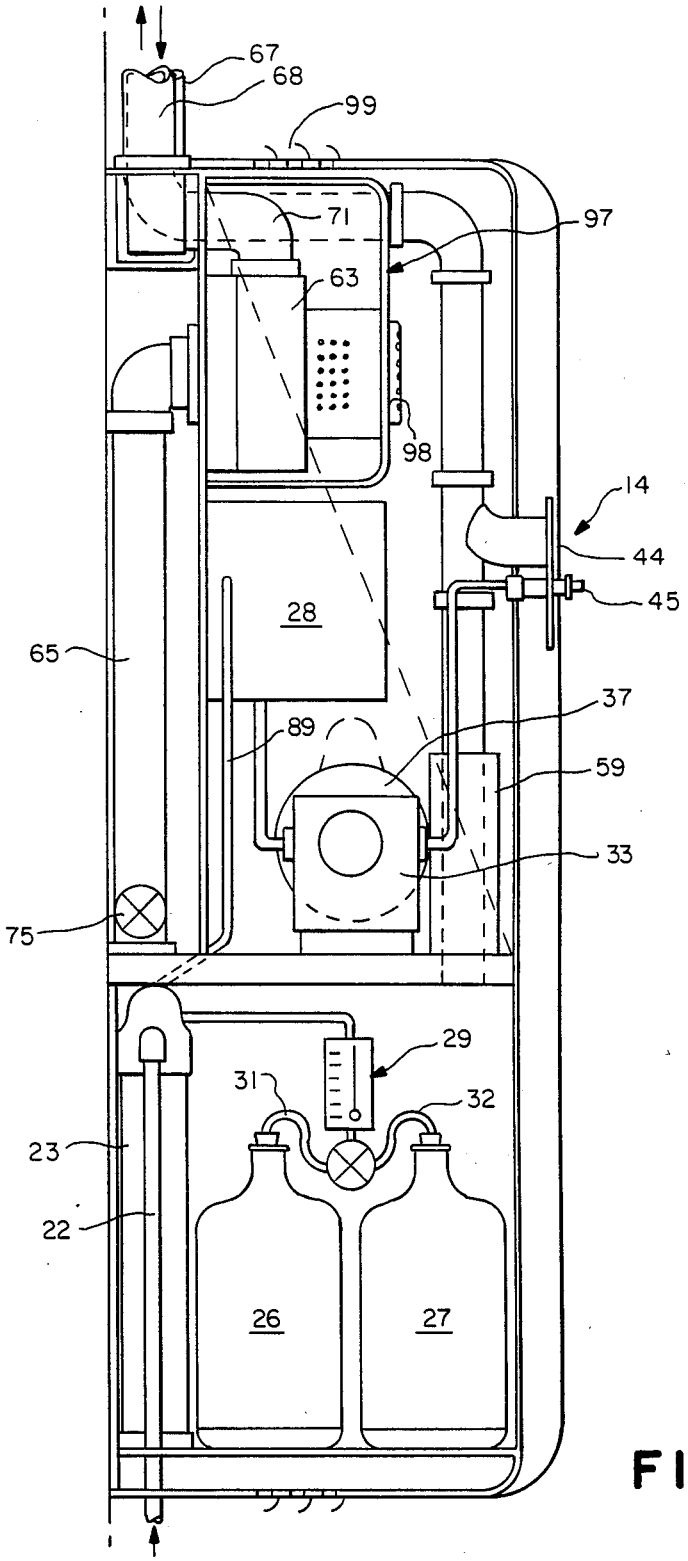
FIGS. 5 and 6 are, respectively, side and front views of the machine shown in FIG. 4.
Figure 6:
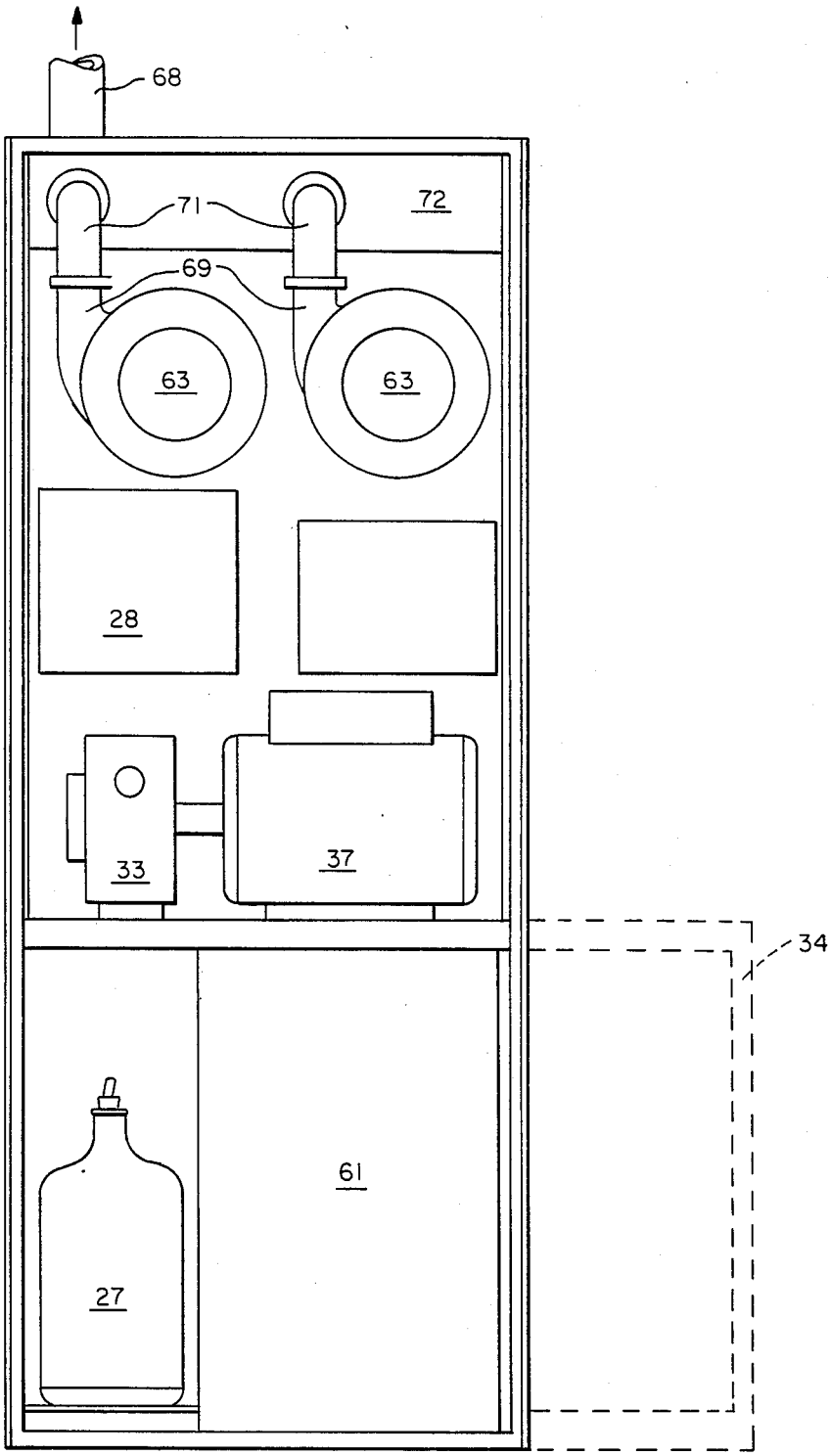

This system is best shown in the broken away side perspective view of FIG. 4 and the side and front views of FIGS. 5 and 6. Hot or cold water is supplied under normal pressure to the vacuum cleaning system 20 via a manual shut-off valve 21 and inlet line 22 to a twenty-five micron cartridge water filter 23, and then to an automatic venturi injector 24. The passage of water through the venturi injector and into line 25 injects liquid chemical solutions from two standard one-gallon bottles 26 and 27 into water line 25, which transports the aqueous chemical mixture to the holding tank 28. A manually adjustable flow meter 29 meters the chemical solution at the rate of 0–6 ounces of chemical solution per gallon of water. A manually-operated three-way valve 30 intercepts lines 31 and 32 between the bottles 26 and 27 and the flow meter 29, for selecting the flow from one or both (or neither) of the bottles. The one-gallon capacity solution holding tank 28 (the tank cover/lid is not shown) is the reservoir for pump 33. Movement of fluid into and out of the tank, as well as within the tank, aids in uniformly mixing the metered chemical solution into the water. The flow of liquid into the holding tank 28 is controlled by conventional low level and high level float switches 106 and 107 (FIG. 14) which control solenoid valve 108 to control the flow of fluid over line 25 into the tank, to fill the tank when the tank fluid level is below a preset low level, and to shut off the flow at a preset high level.

The advantage of the water and the chemical supply system include the convenience of having an on-board water filter and an on-board chemical supply and, further, the option of having a dual chemical supply and metering capability, and the flexibility of mixing chemicals from the two (or more) bottles, all in a small, compact system.

In addition, the multiple functions of the overall system 20 combined with the existence of the dual chemical injection system make the overall system 20 ideally suited for use in a number of cleaning and vacuuming applications. There are available a number of chemical cleaning and conditioning solutions which may be used in the present system. Perhaps the two most widely used commercially available chemical solutions are carpet cleaning detergent and hard surface floor cleaner, both of which are used in the hydro-extraction mode of operation. Other chemical solutions, which are also commercially available from the assignee, include pressure washing cleaner, degreasing cleaner, clean room cleaning solution, anti-static cleaning solution and QUATTM, quaternary ammonium disinfectant. The side door 36, FIG. 3, provides convenient access to the chemical storage compartment at the lower left section of the machine for adjusting the setting of flow meter 29 and valve 30 and for replacing or servicing the flow meter, the valve, cartridge filter 23 and the bottles 26, 27. An access door (not shown) is provided at the front of the cover 35.

It should be mentioned that the two bottles 26, 27 and associated selection and metering systems permit changing the cleaning functions and the amount of metered chemical solutions by simply turning the valve 30 and by adjusting flow meter 29. Futhermore, there is sufficient interior space within the chemical storage compartment to add additional storage bottles and thereby expand the dual chemical injection system to a multiple chemical injection system. The machine cabinet is organized to facilitate expansion at the side, as indicated in phantom at 34, FIG. 6, or simply to add more chemical solution bottles internally.

SOLUTION PUMP PRESSURE SYSTEM (Pump Section 91)

The premixed liquid chemical cleaning solution in holding tank 28 is discharged over line 41 to the pump 33. The pump is operated by motor 37 for discharging the liquid cleaning solution at a preselected pressure over outlet line 42 to the solution pressure connection 45 at the machine outlet 14 and over conduit line 13 (FIG. 1) to the remote outlets 14.

Assuming an appropriate tool 17 and its associated vacuum hose 50 and solution hose 51 are connected to the outlet 14 and that water inlet valve 21 is open, operation of the water and chemical supply system is initiated by turning on the pump motor at the wall outlet switch 105 (FIG. 14) so that the selected chemical cleaning solution is supplied under controlled pressure to the tool 17 for application to rugs, floors, walls, ceilings or other objects or fixtures. A commercially available unloader valve 52 (not shown) is mounted on the discharge side of the pump for relieving pressure on the pump when fluid is not flowing from the cleaning tool. When the tool operator squeezes (opens) a trigger valve (not shown) on the cleaning tool 17, the unloader valve diverts cleaning solution from the pump system via hose 51 to the dispensing head of the tool. Releasing (closing) the trigger valve terminates the flow of chemical cleaning solution from the tool 17 and causes the unloader valve to "unload" the pump discharge pressure and flow cleaning chemical back to the solution tank.

Another of the advantages of the cleaning system 20 relates to the use of a solution pump system which is modular in implementation and can be readily replaced by a system of different capacity, including systems of very large pressure capacity. As presently implemented, the pump and motor are provided in three interchangeable systems. The first is probably most suitable for residential use and comprises a diaphragm pump and permanent magnet motor at about 1/10th horsepower. This system is rated at 40 psi pressure at a maximum of 1.1 gallons per minute. A second system comprises a twin-piston positive displacement pump and a $\frac{3}{4}$ horsepower motor and is rated at 350 psi at a maximum flow of 2.2 gallons per minute. The third system comprises a twinpiston positive displacement pump and a $1\frac{1}{2}$ horsepower motor and is rated at 1,000 psi at 2.2 gallons per minute. The latter two systems are intended primarily for commercial use. Despite the small physical size of system 20, the extremely high pressure which is available from the third system and the high vacuum capability described below provide the capability to service 20,000 square feet using lines which can extend approximately 150 feet in any direction.

VACUUM SYSTEM (Vacuum Section 92)

Referrring further to FIG. 4, the function of the vacuum system is to pick up liquid, such as water or spent cleaning solution, wet and dry dirt, and debris. One of a number of available tools 17 is connected to the outlet 14 for picking up the debris, liquid, etc. and directing it under system vacuum suction through hose 50 and internal machine vacuum pipe 57 through an on-board interceptor filter 59 and into recovery tank 61. The interceptor filter is a rectangular filter, approximately 3 square feet in filter area, which is mounted at the top of the recovery tank 61. The filter extracts large debris and trash from the inlet waste water before the water is passed to the recovery tank 61. In the illustrative embodiment, the tank is connected by vacuum pipes 65—65 to one or a plurality of centrifugal vacuum blowers, 63—63, (also called vacuum pumps) which create vacuum suction. The pipes 65—65 connect the individual blowers to the recovery tank 61. In the present embodiment the recovery tank is itself an open-top fiberglass enclosure having a flanged upper surface which butts against the base 81 to provide a sealed tank enclosure. All openings in the recovery tank, including the holes for the vacuum intake pipe 57 and for the drain pipe 66, are sealed by gaskets.

The vacuum suction generated by the centrifugal vacuum blowers 63—63 is applied to the recovery tank 61 by the vacuum pipes 65—65, and from there via the vacuum inlet pipe 57 to the machine outlet 14 and via remote vacuum pipe 67 to building remote outlets 14 and to any tool 17 which is connected to a wall or machine outlet.

Figure 7:
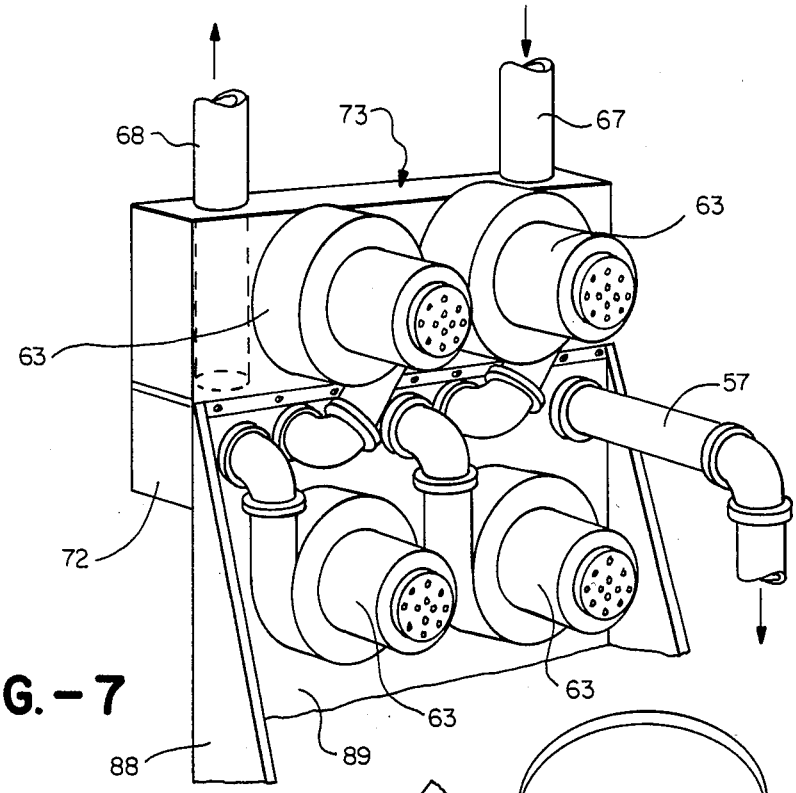
FIG. 7 illustrates the mounting of an optional upper frame section containing additional vacuum blowers to the machine shown in FIG. 4.

As mentioned above, vacuum suction is generated by one or more of the centrifugal vacuum blowers 63—63. The illustrated embodiment of system 20 uses a maximum of four centrifugal vacuum blowers. The exhaust stack 69 of each blower is connected by an elbow 71 to a 15 in.×5 in.×3 in. rectangular muffler/exhaust manifold 72 for collectively exhausting the blowers through port 68. For applications which require only one or two blowers, the blowers are mounted in a single row at the top of machine back panel 89. Referring to FIG. 7, to form a very high vacuum-capacity system, a 18 in.×8 in.×3 in. supplemental frame section 73 is mounted over the inlet and exhaust pipe 67, 68 and bolted to the exhaust manifold 72 and back panel 89 to supply mounting space for the third and fourth blowers along a second, upper row.

The vacuum system is one of the primary advantages of the present machine 10. The upper mounting section 92, the common muffler/exhaust manifold 72 and bolton supplemental frame 73 (which is made possible by the mounting position and the exhaust manifold), together provide an easily altered, modular, building block configuration which imparts a wide range of system vacuum suction capabilities.

Figure 8:
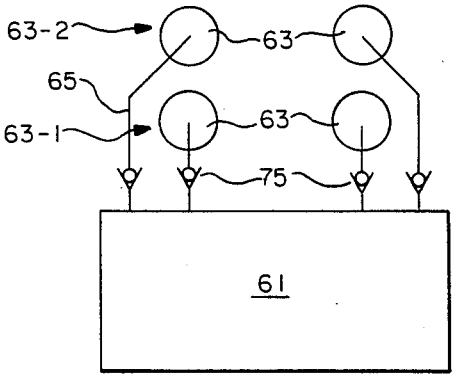
FIGS. 8, 9 and 10 schematically illustrate parallel, series and series-parallel vacuum source interconnections which can be used in the central vacuum unit of the present invention.

Installations which do not require extremely long runs of vacuum pipe, which would result in higher air flow losses than short runs at the same diameter pipe, can use several blowers installed and running in parallel to produce a high volume of air flow. This arrangement is illustrated in FIG. 8 wherein one or two vacuum pump panels 63-1, 63-2 each contain one or two blowers 65 which are connected to the recovery tank 61 by individual vacuum pipes 65—65.

To illustrate parallel-connection flow capacities, consider the following exemplary flow rates for an actual working embodiment of the system 10 which uses three-stage centrifugal vacuum blowers or pumps operating off a 220/240 volt AC power supply which individually provide air flow of about 90 cfm (cubic feet per minute; open) and 95 inches of water lift (sealed). Two blowers connected in parallel (dual-vacuum system; lower row or panel 63-1) provide an air flow of 130 cfm (open) and 95 inches of water lift (sealed). Three blowers in parallel (tri-vacuum system) provide 150 cfm (open) and 95 inches of water lift (sealed). Finally, four blowers installed in parallel (quad-vacuum system) provide 170 cfm (open) and 95 inches of water lift (sealed). Using the muffler/exhaust 72, the blower noise is less than 85 decibels.

Those of skill in the art will appreciate that the diameter of the vacuum pipes 57, 65, 67 is selected to provide the necessary ceiling rise and velocity to carry water and debris from the floor to the ceiling, but without generating sufficient velocity to destroy or degrade the filters 59 or the other system components. In the illustrated machine 20, two-inch diameter pipes satisfy both requirements. However, the diameter could be increased or decreased somewhat and still meet the above requirements.

Figure 9:
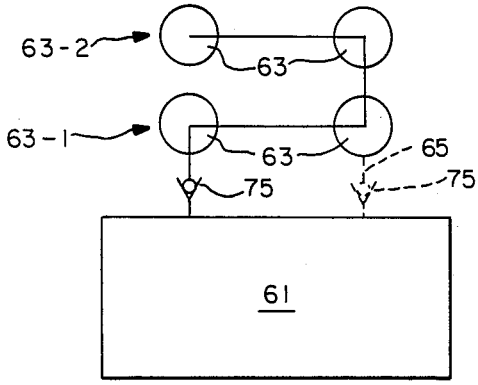

For those machines 20 which must meet varied operational requirements, several small centrifugal vacuum sources or one large positive displacement vacuum source, or a combination of both, can be used. For example, the illustrated quad-vacuum system or an even larger system can be used. Individual switches S1–S4 (FIG. 14) are used for the vacuum sources 63—63 to select the number of vacuums which operate during a particular cleaning job. For example, one vacuum might be used for light cleaning jobs, such as cleaning upholstery fabric or drapes, while four vacuums typically are best for such heavy duty applications as cleaning garage floors or grocery meat market floors. Each vacuum pipe 65 has a check valve 75 (FIGS. 5 and 8) therein which provides uni-directional air flow in the pipe and therefore prevents the other vacuums from sucking air through a pipe when its associated vacuum is turned off or inoperative. Also, the recovery tank has an associated automatic float switch 76 which is located in the recovery tank 61. When water in the recovery tank 61 reaches a predetermined high level, the float switch 76 activates timer relay K1 (FIG. 14) to turn off the vacuum pumps, typically for 20 to 60 seconds, to stop the inlet of liquid via pipe 57 (FIG. 4). When the recovery tank has emptied and float switch has opened, and after the timer relay has reset, vacuum operation is resumed. For long vacuum pipe runs or simply to maximize vacuum suction (and water lift) at somewhat reduced total air flow volume, several vacuum blowers 63—63 can be connected in series as shown in FIG. 9. For example, for two vacuum blowers connected in series (such as the blowers in lower row 631, which are connected to the recovery tank 61 by the vacuum pipe shown dotted at the right side of the figure), the above-described three stage blowers provide approximately 160 inches of water lift (sealed) and air flow of about 90 cfm. Four such vacuum blowers connected in series as shown in FIG. 9 provide approximately 180 inches of water lift (sealed) and air flow of about 90 cfm (open).

Figure 10:
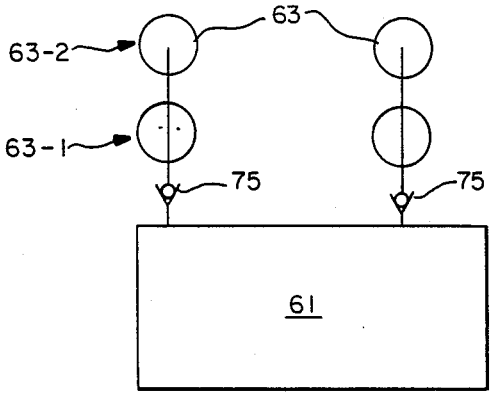

To provide an optimized combination of air flow and water lift/suction, a series-parallel arrangement can be used, such as that shown in FIG. 10. For the illustrated arrangement of a parallel pair of two series-connected vacuum blowers 63—63, the above-described vacuum blowers provide air flow of approximately 130 cfm (open) and approximately 160 inches of water lift (sealed). Additional flexibility can be provided in each of the series, parallel, and series-parallel configurations by using on/off switch S1–S4 (FIG. 14) for each blower.

As shown most clearly in FIG. 5, a cooling shroud 97 has openings 98 for the individual vacuum blowers for directing cooling air flow over the blowers and to outlet 99.

It should be noted that in order to provide five or six or more blowers requires only that an additional bolton frame section 73 be added for each additional row of two blowers, or that a single bolten frame section be provided for mounting all optional blower rows.

Figure 12:
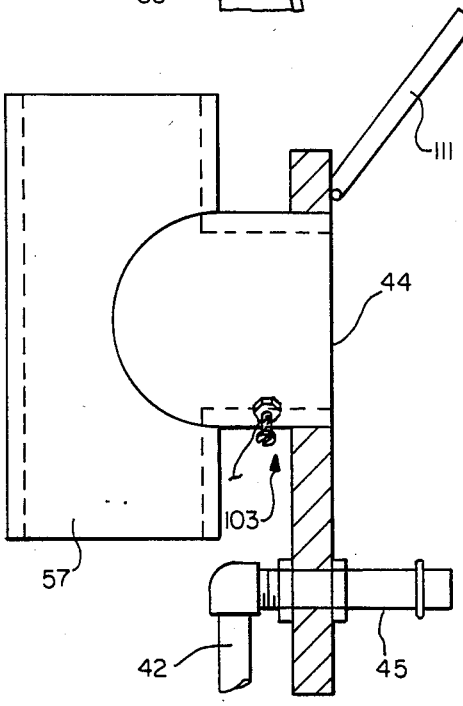
FIGS. 12 and 13 are front and side views of a vacuum/pressure outlet.
Figure 13:
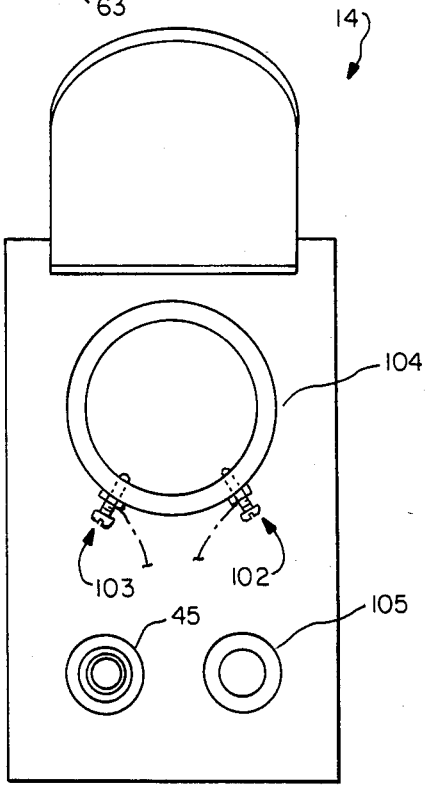
Figure 14:
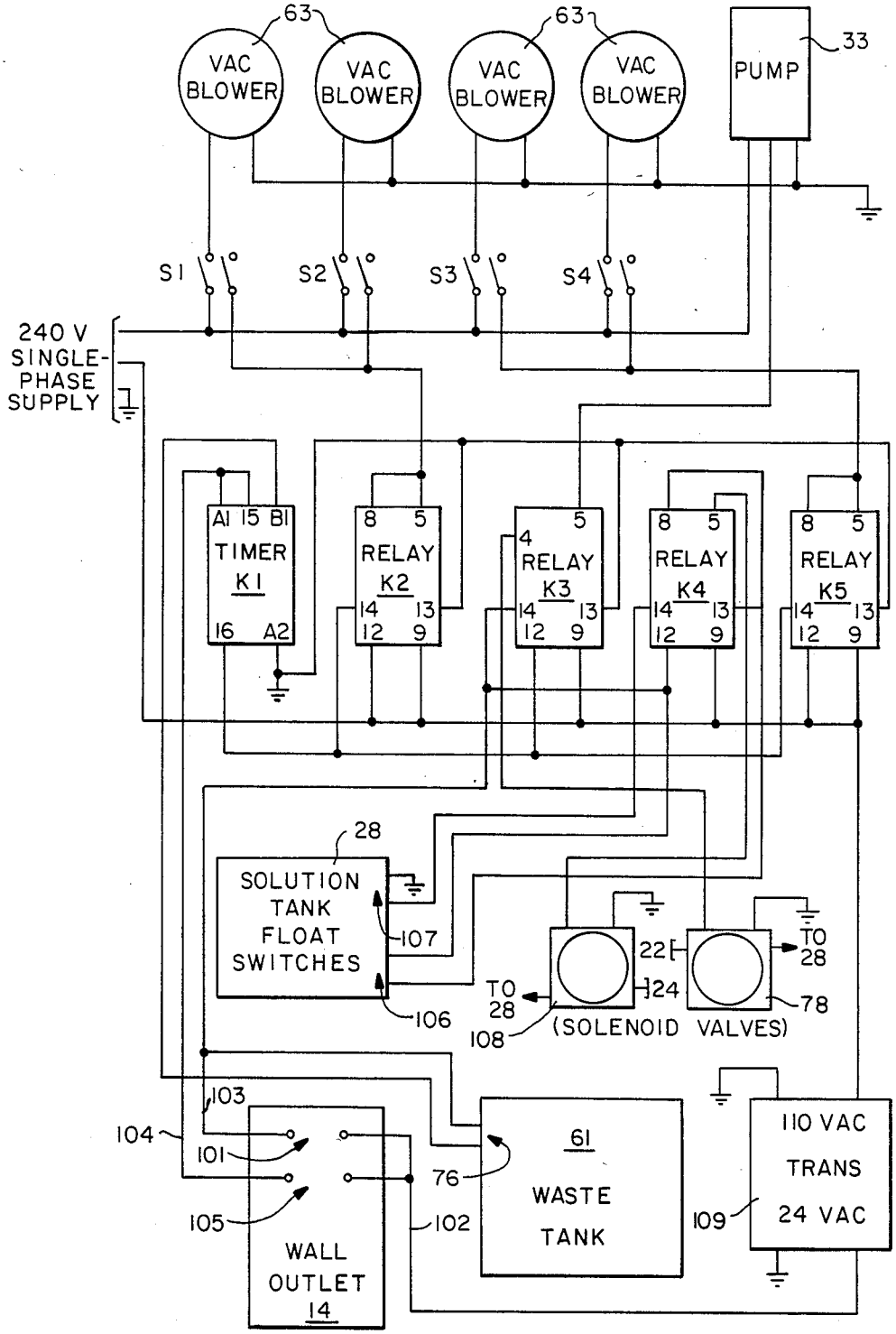
FIG. 14 is a schematic showing the electrical control system of the present invention.

Referring to FIGS. 12–14, both dry vacuuming and wet vacuuming operations of the vacuum system 20 are controlled by switches or connections 101—101 which are mounted in the wall outlet. Referring to FIG. 12, the connections 101—101 are screwbacked ball detents 102 and 103. When the stainless steel end fitting of vacuum tube 50 is inserted into the vacuum receptacle 44 of an outlet 14, the end fitting closes the circuit across electrical control lines 102, 104 (FIG. 14) to operate the vacuum blowers 63—63. Thus, connection of the vacuum hose 50 to an outlet 14 automatically turns on the vacuum blowers. Also, after connection of the solution line 51 to the pump pressure outlet 45, pump switch 105 is pushed to close the circuit across lines 102, 104 to turn on high pressure pump 33.

The machine 20 response to incoming dry dust and debris (dry vacumming) and liquid with or without debris (wet vacuuming) is automatic. The only difference between wet and dry vacuuming is the use of water injection during the dry vacuum cycle to knock out dust and light debris from the incoming air stream into the recovery tank 61. Referring to FIG. 14, when the pump switch 105 is not activated and the pump 33 is not running, water injection is provided by an injector valve 78 which is located in the inlet vacuum pipe 57 just above the interceptor filter 59. Water typically is supplied to the injector valve 78 by a water line 79 (FIG. 14) which is tapped off the main water inlet line 22. The injector spray knocks the dry dust and debris into the recovery tank 61 as an aqueous mixture so that the recovery tank and filter system reacts to the resulting liquid contents of the tank in precisely the manner described below regarding wet vacuuming operation.

Recovery Tank and Interceptor Filter System

(Recovery Section 87)

As alluded to previously, dry and wet vacuuming operations are quite similar, and are done under the control of the on/off connection located in the vacuum connection 44 of wall outlet 14. The only difference in machine control for the two modes of operation involves the water injection which is used only during dry vacuum operation. As the result of the use of water injection during dry vacuuming, both dry and wet vacuuming input liquid to the recovery tank. Thus, the wet vacuum operation described below applies equally to the dry vacuum, wet vacuum and hydro-extraction vacuum modes of operation.

Referring again to FIG. 4, during wet vacuuming operation, the interceptor filter 59 removes large debris (J 0.100 inches in size) from liquid which is inlet to the recovery tank 61. The 15–20 gallon capacity recovery tank 61 is made of fiberglass; gaskets are applied to all openings to provide an airtight enclosure and to thereby enhance the vacuum suction capabilities of the vacuum system. Recovery tank baffles (not shown) prevent incoming fluid from entering the vacuum pipe 65—65. The drain pipe 66 is connected to the building sewer line and includes a check valve 94 in its upper end.

Figure 11A:
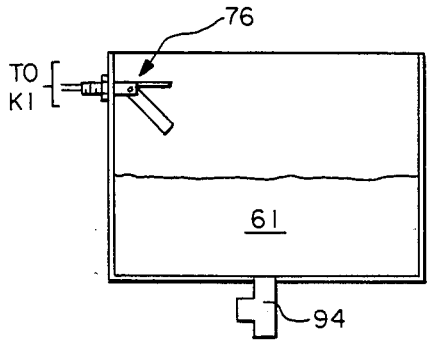
FIGS. 11A and 11B illustrate operation of the automatic float valve in controlling vacuum operation in response to the waste recovery tank fluid level.
Figure 11B:
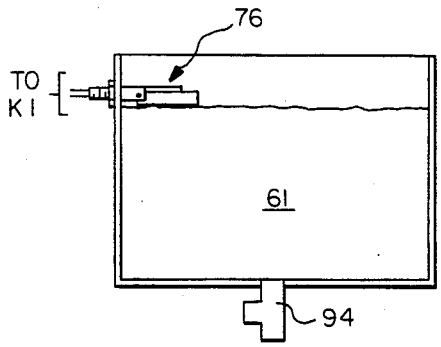

The check valve 94 and the previously mentioned float switch 76 (FIGS. 11A and B) provide a fully automatic dump/drain system. The check valve 94 is normally open (i.e. when the recovery tank is not under vacuum) and allows full draining of the tank contents into the sewer. When the vacuum sources 63—63 apply vacuum suction to the recovery tank, the check valve 94 closes to prevent external fluid from being drawn through the drain pipe 66 into the recovery tank.

The automatic float switch 76 operates in response to a preset high tank fluid level to turn off the vacuum sources to release the vacuum and stop delivery of water into the recovery tank via the vacuum inlet pipe 57. In addition, turning off the vacuum blowers and thus releasing system vacuum initiates automatic check valve-controlled dumping of the recovery tank contents. When the tank contents are completely drained, vacuum suction recovery is automatically restarted. That is, the float switch 76 reopens and timer K1 automatically turns on the vacuum sources 63—63 to start delivery of liquid via vacuum pipe 57 into the tank; reapplication of the vacuum causes check valve 94 to close to restore full vacuum operation.

WALL OUTLET SYSTEM

The vacuum cleaning machine is activated at the machine outlet 14 or any one of several wall outlets 14 installed throughout a building which are connected by the vacuum pipes 67 and the solution hoses 42 (FIG. 4) and the electrical wiring to the vacuum switches and pump switch (FIG. 14).

As described previously, dry vacuuming operation is initiated by simply plugging a metallic pipe on the end of the vacuum hose 50 into wall outlet 14 at vacuum connection 44 (FIG. 12). The vacuum connection 101 is automatically closed, turning on the vacuum sources 63—63. At the same time, water injection is also turned on by solenoid valve 78 and continues until the vacuum hose is removed from the wall outlet or the pump switch is turned on (see next paragraph).

Wet or hydro/vacuuming operation is initiated by plugging vacuum hose into vacuum connection 44 as before, plugging solution hose into solution connection 45 and turning on pump switch 105. (When the pump 33 is running, there is no water injection.) Pump and vacuum continue to operate until turned off at the wall outlet by turning off pump switch 105 and disengaging solution hose 51 and vacuum hose 50 from the wall outlet connections. (Note that the recovery tank filling will temporarily turn off vacuum for 20–60 seconds to allow it to drain.)

High pressure cleaning, degreasing, etc., is done by plugging solution hose 51 into solution connection 45. In this and the other modes of operation, the selection of an aqueous chemical solution or of water alone is made using switch 30 and flow meter 29.

The operation of the self-contained vacuum cleaning system 20 is conveniently summarized with reference to the wiring diagram of FIG. 14. An electrical component box 110 is provided for the relays, transformer, etc. The on/off operation of the four vacuum blowers is controlled by manual switches S1 through S4. The overall operation of the system is controlled by the previously mentioned timer relay K1 and relays K2 through K5. K1 is a Syrelec Type BCR delay-on-break single pole-double throw timer relay or the equivalent.

K2–K5 are each Idec Type RH2 double pole-double throw relays or the equivalent. The control provided by the relays K1K5 includes: empty waste recovery tank 61 operation (K1); vacuum blower operation (two left-side blowers; K2); pump motor 33 and water injection solenoid valve 78 (K3); solution tank level control (K4); and vacuum blower operation (two right-side vacuum blowers; K5). Of course, the connection of the vacuum blowers to the relays can be changed to accommodate different mounting arrangements.

In operation, plugging the vacuum hose 50 into the vacuum connection 44 of an outlet 14 establishes electrical connection across the lines 102, 103 to apply 24 volts AC from the transformer via relay K1 and relays K2 and K4 to turn on those vacuum blowers 63—63 which are selected by manual switches S1–S4. For wet vacuuming or other operations which use the high pressure fluid pump 33, pump switch 105 is depressed at the appropriate outlet 14 to establish connection across lines 102, 104 so that 24 volts AC is applied from the transformer 109 by the relay K3 to operate the pump to pump fluid under pressure over line 42 to the wall outlet 14 and the external line 51. Of course, the pump 33 can be operated without vacuum operation, for example, for high pressure washing or degreasing operations such as that illustrated by numeral 6 in FIG. 1.

As discussed previously, operation of the pump 33 transfers fluid at high pressure from the chemical solution storage tank 28 over line 42 to the pressure fluid connection 45 at the outlet 14. When the fluid level in the tank 28 approaches a predetermined low level, lower float switch 106 opens to set the contacts in relay K4 for activating the fill solenoid valve 108 to allow the flow of water liquid in line 25 and fill the chemical solution storage tank 28. When the fluid level within the storage tank 28 reaches a predetermined high level, high level float switch opens, setting the contacts of relay K4 to open the electrical connection to the solenoid valve 108 so that the spring-biased valve resets to its normally closed position and terminates the flow of fluid into the tank 28.

For dry vacuuming, that is, when vacuuming without using pump 33, the open connection at wall outlet switch 105 sets the contacts of relay K3 to activate the water injection solenoid valve 78 to open the valve. Water is injected from line 22 into the vacuum inlet tube 57. Conversely, when the switch 105 is depressed to establish connection across lines 102, 104, the same set of contacts in relay K3 are opened so that the water injection solenoid valve 78 returns to its normally closed position to prevent water injection.

An alternative vacuum/pressure outlet 14 includes an inner mounting plate which attached to the inside of the building wall, for example to a stud. The inner plate mounts the outlet end of the vacuum pipe 57 and the pressurized liquid outlet line 42. A second plate or cover is provided at the outside of the building wall and is attached to the inner plate by screws or the like. The outer plate typically comprises a frame and bezel that fit over the associated wall opening, and mounts the hinged cover 111 the vacuum receptable 44 (and switches 102 and 103) and the pump switch 105, and includes a hole for receiving the pump pressure fitting 45. The two-plate construction facilitates mounting and connecting the vacuum and pressure fittings and the electrical lines. The vacuum and pressure connections are completed and the four electrical wires are provided when the inner plate is installed. The wires can be connected—two to the switches 102, 103 and two to the pump switch 105—when the outer plate is installed.

Thus, there has been described a compact, multiple-function self-contained vacuum cleaning system which is expandable and of variable capacity.

Having described a preferred embodiment of such system, what is claimed is:

1. A self-contained vacuum cleaning system of the type for supplying liquid under pressure and vacuum suction to an outlet adapted for connection to a pressure application and a vacuum suction tool, comprising:

a frame;

a water inlet line;

chemical supply means mounted within the frame and being adapted for receiving a plurality of chemical solution containers and for metering a selected flow of chemical solution into the inlet line to provide a flow of metered chemical-aqueous fluid;

a tank adapted for receiving and storing the metered fluid;

a pump adapted for supplying metered fluid from the tank under pressure to the outlet;

a substantially enclosed waste recovery tank having a vacuum line connected to the outlet;

the frame including an upper frame section extending across one side thereof mounting a first array of vacuum pumps having exhaust outlet means, said vacuum pumps being connected to the waste recovery tank for applying vacuum suction to the waste recovery tank to make available vacuum suction at the wall outlet directed to the recovery tank;

a vacuum manifold mounted to said upper frame section for receiving exhaust flow from said array of vacuum pumps;

a second frame section mounted over the first section and the vacuum manifold and mounting a second array of said vacuum pumps; and means for connecting said vacuum pumps to the waste recovery tank in a connection selected from series, series-parallel, or parallel arrangements; and means for connecting the exhaust outlet means of said first and second plurality of vacuum pumps to said exhaust manifold.

2. A vacuum cleaning system adapted for multiple function operation including dry vacuuming, wet vacuuming, hydro-extraction vacuuming and pressure washing, wherein the system is self-contained and comprises:

frame support means divided vertically into bottom, middle and top sections, the bottom section containing a chemical storage section and a separate substantially air-tight waste recovery tank; the middle section comprising a chemical pumping section which itself comprises a liquid pump, and a chemical solution storage section; and the upper section comprising a vacuum pump section;

first outlet means including a vacuum suction outlet connected to the waste recovery tank and a liquid outlet connected to the pump, said outlet means being adapted for connection to a vacuum and liquid applicator tool;

the chemical storage section being adapted for containing at least two or more chemical supply containers and including means for selectively metering the chemicals in the containers in a liquid mixture to the chemical solution storage section;

the chemical solution storage section containing a tank adapted for receiving and storing the liquid chemical mixture and for supplying the mixture to the pump means;

the pump of the chemical pumping section being adapted for receiving liquid chemical mixture from the chemical mixture storage tank for supplying the mixture under pressure to the liquid outlet for application to the tool;

the vacuum pump section comprising a first upper frame section extending across one side of said frame means and mounting a first array of at least one vacuum pump connected to the waste recovery tank for applying vacuum suction to the waste recovery tank to make available vacuum suction at the wall outlet directed to the recovery tank;

a vacuum manifold extending across and mounted to the opposite side of said first frame section;

an exhaust stack mounted to and extending upwardly from said manifold;

a return stack adapted for connection to at least a second said outlet means, said return stack extending downwardly through said manifold and being connected in common to the vacuum suction outlet of said first outlet means and to the waste recovery tank;

a second upper frame section mounted over the first frame section and the vacuum manifold and the return and exhaust stacks and being adapted for mounting a second array of at least one vacuum pump;

said first and second arrays of vacuum pumps having exhaust outlet means connected to said exhaust manifold at said first upper frame section; and means for connecting said vacuum pumps to the waste recovery tank in one of series, series-parallel, or parallel connection.

3. The self-contained vacuum cleaning system of claim 1 or 2 wherein said vacuum pumps are connected in parallel to the waste recovery tank.

4. The self-contained vacuum cleaning system of claims 1 or 2 wherein said vacuum pumps are connected in series-parallel to the waste recovery tank.

5. The self-contained vacuum system of claims 1 or 2 wherein said vacuum pumps are connected in series to the waste recovery tank.

6. The self-contained vacuum cleaning system of claims 3, 4 or 5 wherein said vacuum pumps are individually and selectively operable for thereby providing a preselected vacuum suction.

7. The self-contained vacuum cleaning system of claim 2, wherein said vacuum pumps are individually and selectively operable for thereby providing a preselected vacuum suction.

8. A vacuum cleaning system suitable for multiple function operation including dry vacuuming, wet vacuuming, hydro-extraction vacuuming and pressure washing, comprising:

frame support means divided vertically into bottom, middle and top sections, the bottom section containing a chemical storage section and a separate, substantially air-tight waste recovery tank; the middle section comprising a chemical pumping section which itself comprises a pump, and a chemical solution storage section; and the upper section comprising a vacuum source section;

the chemical storage section adapted for containing at least two or more chemical supply containers and means for selectively metering the chemicals in the containers in a liquid mixture to the chemical solution storage section;

the chemical solution storage section containing a tank adapted for receiving and storing the liquid chemical mixture and for supplying the mixture to the pump;

the fluid pump being adapted for receiving liquid chemical mixture from the chemical mixture storage tank and supplying the mixture under pressure to the outlet for application to the tool;

the vacuum source section being adapted for mounting a plurality of vacuum pumps for supplying vacuum suction to the storage tank for directing the vacuum suction from the outlet to the waste recovery tank to thereby make available vacuum pickup at the outlet directed to the recovery tank; and an outlet mounted on the frame and communicating with the waste recovery tank via a vacuum inlet tube and an inline filter and further communicating with the pump by a liquid pressure line, and being adapted for connection to a cleaning tool for supplying the chemical mixture under pressure to the tool and for applying vacuum suction to the tool to effect vacuum pickup and including switch means for activating the vacuum pumps and the fluid pump.

9. The vacuum cleaning system for claim 8, further comprising:

an upper frame section extending across one side of said frame and adapted for receiving a first array of at least two vacuum pumps, each having an exhaust outlet and a vacuum inlet for applying vacuum suction to the waste recovery tank to make available vacuum suction at the wall outlet directed to the recovery tank, a vacuum manifold extending across and mounted to the opposite side of said upper frame section for receiving exhaust flow from said array of vacuum pumps;

a second upper frame section mounted over the first section and the vacuum manifold and being adapted for mounting a second array of at least two of said vacuum pumps;

the exhaust outlets of said first and said second arrays of vacuum pumps being connected to said exhaust manifold at said upper frame section; and wherein said vacuum pump inlets are connected to said waste recovery tank in a connection arrangement selected from series, parallel, and series-parallel arrangements.

10. The self-contained vacuum cleaning system of claim 9 wherein said vacuum pumps are connected to the waste recovery tank by vacuum pipes having valve means therein for limiting air flow to uni-directional flow away from the waste recovery tank.

11. The self-contained vacuum cleaning system of claim 9 wherein said vacuum pumps are individually and selectively operable for thereby providing a preselected vacuum suction.

* * * * *